US008961045B2

(12) United States Patent
McNestry et al.

(10) Patent No.: US 8,961,045 B2
(45) **Date of Patent: *Feb. 24, 2015**

(54) TAPE DRIVE

(71) Applicant: Videojet Technologies (Nottingham) Limited, Nottingham (GB)

(72) Inventors: Martin McNestry, Derbyshire (GB); George Borkey Yundt, Andover, MA (US)

(73) Assignee: Videojet Technologies (Nottingham) Limited, Nottingham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/290,314

(22) Filed: May 29, 2014

(65) Prior Publication Data

US 2014/0267534 A1 Sep. 18, 2014

Related U.S. Application Data

(63) Continuation of application No. 12/043,194, filed on Mar. 6, 2008, now Pat. No. 8,770,874.

(60) Provisional application No. 60/894,508, filed on Mar. 13, 2007.

(30) Foreign Application Priority Data

Mar. 7, 2007 (GB) ..... 0704365.6

(51) Int. Cl.
*B41J 33/16* (2006.01)
*B41J 2/325* (2006.01)
*B41J 33/34* (2006.01)

(52) U.S. Cl.
CPC . *B41J 2/325* (2013.01); *B41J 33/34* (2013.01)
USPC ..... 400/236; 400/225; 242/334; 242/390.9; 242/412.1

(58) Field of Classification Search
USPC ..... 400/236
See application file for complete search history.

(56) References Cited

U.S. PATENT DOCUMENTS 3,584,805 A 6/1971 Lee
3,606,201 A 9/1971 Petusky (Continued)

FOREIGN PATENT DOCUMENTS

CN 1473110 A 2/2004
DE 4215830 11/1999

(Continued)

OTHER PUBLICATIONS

Datamax DMX 5000 ATB Printer, Maintenance Manual, Documentation P/N:88-0080-01, Revision B, Datamax Corporation, 1987, 1993.

(Continued)

*Primary Examiner* — Jill Culler
(74) *Attorney, Agent, or Firm* — Robert L. Wolter, Esq.; Beusse Wolter Sanks & Maire, P.A.

(57) ABSTRACT

A thermal transfer printer incorporating a tape drive comprising a first torque-controlled motor and a second position-controlled motor, two tape spool supports on which spools of tape may be mounted, each spool being drivable by a respective one of said motors, and a controller for controlling the energization of the motors such that the tape may be transported in at least one direction between spools mounted on the spool supports. The controller is arranged to determine a control signal to be provided to the torque-controlled motor to set the tape tension, and to provide said control signal to the torque-controlled motor, determination of the control signal including determination of a component intended to compensate for the inertia of a spool of tape driven by the torque-controlled motor.

9 Claims, 1 Drawing Sheet

(56) References Cited

U.S. PATENT DOCUMENTS

| | | | |
|---|---|---|---|
| 3,610,496 | A | 10/1971 | Parker |
| 3,704,401 | A | 11/1972 | Miller |
| 3,781,490 | A | 12/1973 | Phillips |
| 3,836,831 | A | 9/1974 | Van Heelsbergen |
| 3,863,117 | A | 1/1975 | Paschetto |
| 3,889,893 | A | 6/1975 | Silverman et al. |
| 3,902,585 | A | 9/1975 | Mogtader |
| 3,910,527 | A | 10/1975 | Buhler et al. |
| 3,926,513 | A | 12/1975 | Silver et al. |
| 3,982,160 | A | 9/1976 | Goldschmidt et al. |
| 3,984,809 | A | 10/1976 | Dertouzos et al. |
| 4,000,804 | A | 1/1977 | Zaltieri |
| 4,012,674 | A | 3/1977 | Spitsbergen et al. |
| 4,015,799 | A | 4/1977 | Koski et al. |
| 4,025,830 | A | 5/1977 | Delaporte |
| 4,079,828 | A | 3/1978 | Babler |
| 4,091,913 | A | 5/1978 | Ku et al. |
| 4,093,149 | A | 6/1978 | Shroff et al. |
| 4,094,478 | A | 6/1978 | Shroff et al. |
| 4,095,758 | A | 6/1978 | Shroff |
| 4,096,417 | A | 6/1978 | Chambolle |
| 4,156,257 | A | 5/1979 | Roberts |
| 4,161,001 | A | 7/1979 | Sakamoto |
| 4,177,731 | A | 12/1979 | Kleist et al. |
| RE30,448 | E | 12/1980 | Shroff |
| 4,266,479 | A | 5/1981 | Mahoney |
| 4,286,888 | A | 9/1981 | Bennett et al. |
| 4,294,552 | A | 10/1981 | Mako |
| 4,313,376 | A | 2/1982 | Swope et al. |
| 4,313,683 | A | 2/1982 | Brown et al. |
| 4,354,211 | A | 10/1982 | Gilovich et al. |
| 4,366,371 | A | 12/1982 | d'Alayer de Costemore d'Arc et al. |
| 4,375,339 | A | 3/1983 | Dyer |
| 4,448,368 | A | 5/1984 | Skalko |
| 4,479,081 | A | 10/1984 | Harris |
| 4,573,645 | A | 3/1986 | Harris, Jr. |
| 4,577,198 | A | 3/1986 | Hibino et al. |
| 4,589,603 | A | 5/1986 | Muller |
| 4,632,582 | A | 12/1986 | Houston |
| 4,639,880 | A | 1/1987 | Yasuhiro |
| 4,642,655 | A | 2/1987 | Sparer et al. |
| 4,650,350 | A | 3/1987 | Dorner |
| 4,664,336 | A | 5/1987 | Koyama |
| 4,692,819 | A | 9/1987 | Steele |
| 4,696,439 | A | 9/1987 | Sukigara et al. |
| 4,712,113 | A | 12/1987 | Brooks et al. |
| 4,752,842 | A | 6/1988 | Odagiri |
| 4,760,405 | A | 7/1988 | Nagira et al. |
| 4,786,992 | A | 11/1988 | Tajima et al. |
| 4,788,558 | A | 11/1988 | Caldwell et al. |
| 4,895,466 | A | 1/1990 | Hartman et al. |
| 4,897,668 | A | 1/1990 | Nagato et al. |
| 4,909,648 | A | 3/1990 | Hartman et al. |
| 4,924,240 | A | 5/1990 | Herbert et al. |
| 4,952,085 | A | 8/1990 | Rein |
| 4,953,044 | A | 8/1990 | Van Pelt et al. |
| 4,977,466 | A | 12/1990 | Nakata |
| 5,012,989 | A | 5/1991 | Whyte, Jr. et al. |
| 5,017,943 | A | 5/1991 | Ogita et al. |
| 5,039,027 | A | 8/1991 | Yanagihara et al. |
| 5,080,296 | A | 1/1992 | Raggio et al. |
| 5,117,241 | A | 5/1992 | Stephenson |
| 5,121,136 | A | 6/1992 | Kawakubo |
| 5,125,592 | A | 6/1992 | Sato |
| 5,160,943 | A | 11/1992 | Pettigrew et al. |
| 5,162,815 | A | 11/1992 | Hodge |
| 5,218,490 | A | 6/1993 | Sakamoto et al. |
| 5,259,563 | A | 11/1993 | Kakiwaki et al. |
| 5,281,038 | A | 1/1994 | Schofield et al. |
| 5,294,203 | A | 3/1994 | Williams |
| 5,295,753 | A | 3/1994 | Godo et al. |
| 5,297,879 | A | 3/1994 | Oikawa |
| 5,300,953 | A | 4/1994 | Schulte |
| 5,313,343 | A | 5/1994 | Yatomi |
| 5,357,270 | A | 10/1994 | Herbert |
| 5,366,303 | A | 11/1994 | Barrus et al. |
| 5,372,439 | A | 12/1994 | Poole et al. |
| 5,415,482 | A | 5/1995 | Poole et al. |
| 5,477,400 | A | 12/1995 | Kawamata |
| 5,490,638 | A | 2/1996 | Driftmyer et al. |
| 5,505,550 | A | 4/1996 | Kitahara et al. |
| 5,576,751 | A | 11/1996 | Wada et al. |
| 5,604,652 | A | 2/1997 | Nishida et al. |
| 5,609,425 | A | 3/1997 | Kawano et al. |
| 5,639,040 | A | 6/1997 | Honjo |
| 5,647,679 | A | 7/1997 | Green et al. |
| 5,649,672 | A | 7/1997 | Wolff et al. |
| 5,649,774 | A | 7/1997 | Harding et al. |
| 5,700,096 | A | 12/1997 | Satoh et al. |
| 5,701,214 | A | 12/1997 | Inoue et al. |
| 5,720,442 | A | 2/1998 | Yanagihara et al. |
| 5,731,672 | A | 3/1998 | Miyaguchi |
| 5,733,054 | A | 3/1998 | Miazga |
| 5,788,384 | A | 8/1998 | Goodwin et al. |
| 5,795,084 | A | 8/1998 | Stone et al. |
| 5,803,624 | A | 9/1998 | Miazga et al. |
| 5,816,719 | A | 10/1998 | Palmer |
| 5,820,280 | A | 10/1998 | Fox |
| 5,906,444 | A | 5/1999 | Jorgensen |
| 5,971,634 | A | 10/1999 | Buckby et al. |
| 5,993,092 | A | 11/1999 | Palmer |
| 6,000,868 | A | 12/1999 | Watanabe et al. |
| 6,036,382 | A | 3/2000 | Middleton |
| 6,046,756 | A | 4/2000 | Iga et al. |
| 6,082,914 | A | 7/2000 | Barrus et al. |
| 6,089,768 | A | 7/2000 | Barrus et al. |
| 6,128,152 | A | 10/2000 | Mace |
| 6,142,686 | A | 11/2000 | Schanke et al. |
| 6,164,203 | A | 12/2000 | Keller |
| 6,261,012 | B1 | 7/2001 | Haas et al. |
| 6,305,628 | B1 | 10/2001 | Thompson et al. |
| 6,305,629 | B1 | 10/2001 | Chliwnyj et al. |
| 6,307,583 | B1 | 10/2001 | Randolph et al. |
| 6,315,471 | B1 | 11/2001 | Hsieh et al. |
| 6,411,317 | B1 | 6/2002 | Fukuda |
| 6,669,136 | B2 | 12/2003 | Niioka et al. |
| 6,754,026 | B1 | 6/2004 | Koski |
| 6,840,689 | B2 | 1/2005 | Barrus et al. |
| 6,969,064 | B2 | 11/2005 | Ichikawa et al. |
| 2003/0049065 | A1 | 3/2003 | Barrus et al. |
| 2004/0041047 | A1 | 3/2004 | Karp et al. |
| 2004/0146331 | A1 | 7/2004 | McNestry et al. |

FOREIGN PATENT DOCUMENTS

| | | | |
|---|---|---|---|
| EP | 0157096 | | 10/1985 |
| EP | 0176009 | | 4/1986 |
| EP | 0294633 | | 12/1988 |
| EP | 0 329 478 | A2 | 8/1989 |
| EP | 0481579 | A2 | 10/1991 |
| EP | 0481579 | | 4/1992 |
| EP | 0532238 | | 3/1993 |
| EP | 0556066 | | 8/1993 |
| EP | 0582285 | | 2/1994 |
| EP | 0 589 715 | | 3/1994 |
| EP | 0 683 055 | | 11/1995 |
| EP | 0 734 876 | | 10/1996 |
| EP | 0 741 044 | A2 | 11/1996 |
| EP | 0 765 221 | | 4/1997 |
| EP | 0 804 343 | B1 | 11/1997 |
| EP | 0 830 252 | B1 | 3/1998 |
| EP | 0 842 785 | A1 | 5/1998 |
| EP | 0840311 | | 5/1998 |
| EP | 0854480 | | 7/1998 |
| EP | 0 861 735 | | 9/1998 |
| EP | 0936078 | | 2/1999 |
| EP | 0945273 | | 9/1999 |
| EP | 0955178 | | 11/1999 |
| EP | 1000756 | | 5/2000 |
| EP | 1400362 | | 3/2004 |
| EP | 1 409 388 | | 4/2004 |
| EP | 1470926 | | 10/2004 |
| FR | 2783459 | | 3/2000 |

(56) References Cited

FOREIGN PATENT DOCUMENTS

| | | |
|---|---|---|
| FR | 9811893 | 3/2000 |
| GB | 1 361 288 | 7/1974 |
| GB | 1 576 750 | 10/1980 |
| GB | 2077970 | 12/1981 |
| GB | 2087104 | 5/1982 |
| GB | 2 163 915 | 3/1986 |
| GB | 2 175 253 | 11/1986 |
| GB | 2201013 | 8/1988 |
| GB | 2 272 669 | 5/1994 |
| GB | 2289441 | 11/1995 |
| GB | 2298821 | 9/1996 |
| GB | 2 302 523 | 1/1997 |
| GB | 2 306 916 | 5/1997 |
| GB | 2 310 405 | 8/1997 |
| GB | 2 315 244 | 1/1998 |
| GB | 2 343 655 | 5/2000 |
| GB | 2 349 605 | 11/2000 |
| GB | 2354974 | 4/2001 |
| GB | 2 369 326 | 5/2002 |
| GB | 2369602 | 6/2002 |
| GB | 2376662 | 12/2002 |
| GB | 2400582 | 10/2004 |
| GB | 2400818 | 10/2004 |
| GB | 2404703 | 2/2005 |
| GB | 2404896 | 2/2005 |
| GB | 2416237 | 1/2006 |
| GB | 2 422 815 | 8/2006 |
| JO | 60-157891 | 8/1985 |
| JP | 59-17125 | 1/1984 |
| JP | S60-157891 | 8/1985 |
| JP | 60-211653 | 10/1985 |
| JP | 61-169265 | 7/1986 |
| JP | 63-104875 | 5/1988 |
| JP | 63-122045 | 5/1988 |
| JP | 63-317963 | 12/1988 |
| JP | 1-300455 | 12/1989 |
| JP | 1300455 | 12/1989 |
| JP | 04008551 A | 1/1992 |
| JP | 4-274044 | 9/1992 |
| JP | 4-305486 | 10/1992 |
| JP | 05058014 | 3/1993 |
| JP | H5-58014 | 3/1993 |
| JP | A-H06-079938 | 3/1994 |
| JP | 06126995 A | 5/1994 |
| JP | H6-134275 | 6/1994 |
| JP | A-H07-032692 | 2/1995 |
| JP | 08002078 | 1/1996 |
| JP | 08244324 | 9/1996 |
| JP | H8-244324 | 9/1996 |
| JP | 9-151011 | 6/1997 |
| JP | 10-181972 | 7/1998 |
| JP | 2000-229456 | 8/2000 |
| JP | 2004-181691 | 7/2004 |
| WO | WO 92/09517 | 6/1992 |
| WO | WO93/01055 | 1/1993 |
| WO | WO 95/34896 | 12/1995 |
| WO | WO96/14990 | 5/1996 |
| WO | WO 96/28304 | 9/1996 |
| WO | WO 96/32258 | 10/1996 |
| WO | WO97/35727 | 10/1997 |
| WO | WO97/35728 | 10/1997 |
| WO | WO 97/36751 | 10/1997 |
| WO | WO 99/34983 | 7/1999 |
| WO | WO99/46129 | 9/1999 |
| WO | WO 02/22371 | 3/2002 |
| WO | WO03011728 | 2/2003 |
| WO | WO 03/029013 | 4/2003 |
| WO | WO2006/069943 | 7/2006 |

OTHER PUBLICATIONS

University Physics, 9th Edition—Young Freedman, p. 308.

Burke et al, Switchable Stepper Motor Control, IBM Technical Disclosure Bulletin, Nov. 1989, pp. 430-431, vol. 32, No. 63.

Barnett, J.A., Use of Stepper Motor as Variable Load, IBM Technical Disclosure Bulletin, Apr. 1977, pp. 4120-4121, vol. 19, No. 11.

*Markem Corporation* v. *Zipher, Ltd. et al*., Order, Sep. 1, 2009, pp. 1-2, Doc. 117, Case No. 07-cv-06-PB.

*Markem Corporation* v. *Zipher, Ltd. et al*., Order, Jan. 12, 2010, pp. 1-5, Doc. 125, Case No. 07-cv-06-PB.

Datamax Corporation, DMX 5000, ATB Printer, Maintenance Manual, Doc. P/N: 88-0080-01, Revision B, 1987.

DMX-5000 ATB Printer Maintenance Manual.

DMX-5000 Description of the Firmware of the ATB Printer.

TAPE DRIVE

CROSS-REFERENCE TO RELATED APPLICATIONS

This application is a Continuation of U.S. application Ser. No. 12/043,194 filed Mar. 6, 2008, and claims the benefit of U.S. Provisional Application No. 60/894,508 filed Mar. 13, 2007, which claims priority to and is based on United Kingdom Application No. 0704365.6 filed Mar. 7, 2007, and incorporated herein by reference in their entirety.

BACKGROUND OF THE INVENTION

The present invention relates to a tape drive. Such a tape drive may form part of printing apparatus. In particular, such a tape drive may be used in transfer printers, that is, printers which make use of carrier-supported inks.

In transfer printers, a tape which is normally referred to as a printer tape and carries ink on one side is presented within a printer such that a printhead can contact the other side of the tape to cause the ink to be transferred from the tape on to a target substrate of, for example, paper or a flexible film. Such printers are used in many applications. Industrial printing applications include thermal transfer label printers and thermal transfer coders which print directly on to a substrate such as packaging materials manufactured from flexible film or card.

Ink tape is normally delivered to the end user in the form of a roll wound onto a core. The end user pushes the core on to a tape spool, pulls a free end of the roll to release a length of tape, and then engages the end of the tape with a further spool. The spools may be mounted on a cassette, which can be readily mounted on a printing machine. The printing machine includes a transport means for driving the spools, no as to unwind tape from one spool and to take up tape on the other spool. The printing apparatus transports tape between the two spools along a predetermined path past the printhead.

Known printers of the above type rely upon a wide range of different approaches to the problem of how to drive the tape spools. Some rely upon stepper motors operating in a position control mode to pay out or take-up a predetermined quantity of tape. Other known printers rely on DC motors operating in a torque mode to provide tension in the tape and to directly or indirectly drive the spools. Some known arrangements drive only the spool on to which tape is taken up (the take-up spool) and rely upon some form of "slipping clutch" arrangement on the spool from which tape is drawn (the supply spool) to provide a resistive drag force so as to ensure that the tape is maintained in tension during the printing and tape winding processes and to prevent tape overrun when the tape is brought to rest. It will be appreciated that maintaining adequate tension is an essential requirement for the proper functioning of the printer.

Alternative forms of known printer tape drives drive both the take-up spool and the supply spool. A supply spool motor may be arranged to apply a predetermined drag to the tape, by being driven in the reverse direction to the direction of tape transport. In such an arrangement (referred to herein as "pull-drag"), the motor connected to the take-up spool is arranged to apply a greater force to the tape than the motor connected to the supply spool such that the supply spool motor is overpowered and the supply spool thus rotates in the direction of tape transport. The supply spool drag motor keeps the tape tensioned in normal operation.

In a further alternative arrangement a supply spool motor may be driven in the direction of tape transport such that it contributes to driving the tape from the supply spool to the take-up spool. Such an arrangement is referred to herein as "push-pull". The take-up motor pulls the tape onto the take-up spool as tape is unwound by the supply spool motor such that tape tension is maintained. Such a push-pull arrangement is described in our earlier UK Patent No. GB 2,369,602, which discloses the use of a pair of stepper motors to drive the supply spool and the take-up spool. In GB 2,369,602 a controller is arranged to control the energization of the motors such that the tape may be transported in both directions between spools of tape. The tension in the tape being transported between spools is monitored and the motors are controlled to energize both motors to drive the spools of tape in the direction of tape transport.

As a printer gradually uses a roll of tape, the outer diameter of the supply spool decreases and the outer diameter of the take-up spool increases. In slipping clutch arrangements, which offer an essentially constant resistive torque, the tape tension will vary in proportion to the diameter of the spools. Given that it is desirable to use large supply spools no as to minimise the number of times that a tape roll has to be replenished, this is a serious problem particularly in high-speed machines where rapid tape transport is essential. For tape drives that use both a take-up motor and a supply spool motor, the variation in spool diameters can make it difficult to determine the correct drive signal to be supplied to each motor such that tape tension is maintained, and/or that tape is unwound or rewound at the correct rate.

Given these constraints, known printer designs offer a compromise in performance by way of limiting the rate of acceleration, the rate of deceleration, and the maximum speed capability of the tape transport system. Overall printer performance has, as a result, been compromised in some cases.

Known tape drive systems generally operate in one of two manners, that is either continuous printing or intermittent printing. In both modes of operation, the apparatus performs a regularly repeated series of printing cycles, each cycle including a printing phase during which ink is being transferred to a substrate, and a further non-printing phase during which the apparatus is prepared for the printing phase of the next cycle.

In continuous printing, during the printing phase a stationary printhead is brought into contact with a printer tape the other side of which is in contact with a substrate on to which an image is to be printed. The term "stationary" is used in the context of continuous printing to indicate that although the printhead will be moved into and out of contact with the tape, it will not move relative to the tape path in the direction in which tape is advanced along that path. During printing, both the substrate and tape are transported past the printhead, generally but not necessarily at the same speed.

Generally only relatively small lengths of the substrate which is transported past the printhead are to be printed upon, and therefore to avoid gross wastage of tape it is necessary to reverse the direction of travel of the tape between printing operations. Thus in a typical printing process in which the substrate is travelling at a constant velocity, the printhead is extended into contact with the tape only when the printhead is adjacent to regions of the substrate to be printed. Immediately before extension of the printhead, the tape must be accelerated up to, for example, the speed of travel of the substrate. The tape speed must then be maintained at the constant speed of the substrate during the printing phase and, after the printing phase has been completed, the tape must be decelerated and then driven in the reverse direction so that the used region of the tape is on the upstream side of the printhead.

As the next region of the substrate to be printed approaches, the tape must then be accelerated back up to the normal printing speed and the tape must be positioned so that an unused portion of the tape close to the previously used region of the tape is located between the printhead and the substrate when the printhead is advanced to the printing position. Thus very rapid acceleration and deceleration of the tape in both directions is required, and the tape drive system must be capable of accurately locating the tape so as to avoid a printing operation being conducted when a previously used portion of the tape is interposed between the printhead and the substrate.

In intermittent printing, a substrate is advanced past a printhead in a stepwise manner such that during the printing phase of each cycle the substrate and generally but not necessarily the tape, are stationary. Relative movement between the substrate, tape and printhead are achieved by displacing the printhead relative to the substrate and tape. Between the printing phase of successive cycles, the substrate is advanced so as to present the next region to be printed beneath the printhead, and the tape is advanced so that an unused section of tape is located between the printhead and the substrate. Once again rapid and accurate transport of the tape is necessary to ensure that unused tape is always located between the substrate and printhead at a time that the printhead is advanced to conduct a printing operation.

U.S. Pat. No. 6,082,914 discloses a thermal transfer printer comprising an ink ribbon driven between a supply spool and a take-up spool via a printhead. The printhead transfers ink from the ink ribbon to a media, which is also driven past the printhead. Each spool is driven by a separate DC motor and controlled by a controller which detects the back EMF (BEMF) of the motors and controls drive of the motors.

The spools have inertia which is taken into account when determining the rate at which the motors are driven. This is used to calculate the appropriate motor torque during ribbon acceleration and deceleration to allow constant ribbon tension to be maintained.

The requirements of high speed transfer printers in terms of tape acceleration, deceleration, speed and positional accuracy are such that many known drive mechanisms have difficulty delivering acceptable performance with a high degree of reliability. Similar constraints also apply in applications other than high-speed printers, for instance drives used in labelling machines, which are adapted to apply labels detached from label web. Tape drives in accordance with embodiments of the present invention are suitable for use in labelling machines in which labels are detached from a continuous label web which is transported between a supply spool and a take-up spool.

BRIEF DESCRIPTION OF THE INVENTION

It is an object of embodiments of the present invention to obviate or mitigate one or more of the problems associated with the prior art, whether identified herein or elsewhere. It is a further object of embodiments of the present invention to provide a tape drive which can be used to deliver printer tape in a manner which is capable of meeting the requirements of high speed production lines, although the tape drive of the present invention may of course be used in any other application where similar high performance requirements are demanded.

According to the present invention, there is provided, a tape drive comprising a first torque-controlled motor and a second position-controlled motor, two tape spool supports on which spools of tape may be mounted, each spool being drivable by a respective one of said motors, and a controller for controlling the energization of the motors such that the tape may be transported in at least one direction between spools mounted on the spool supports, wherein the controller is arranged to provide a control signal to the torque-controlled motor to set the tape tension, the control signal including a component to compensate for the inertia of a spool of tape driven by the torque-controlled motor.

The component may be indicative of an additional torque to be supplied by the torque control motor to compensate for torque generated by inertia of the spool of tape driven by the torque controlled motor. Torque may be determined by the product of inertia and angular acceleration.

It is preferred that each spool support is coupled to a respective motor by means of a drive coupling providing at least one fixed transmission ratio. Preferably, the ratio of angular velocities of each motor and its respective spool support is fixed. Such an arrangement requires that control of a motor to cause a desired linear tape movement from or to a respective spool takes into account the circumference of that spool.

The drive coupling may comprise a drive belt. Alternatively, as each spool support has a respective first axis of rotation and each motor has a shaft with a respective second axis of rotation, the respective first and second axes may be coaxial. Respective drive couplings may interconnect a respective spool shaft to a respective motor shaft.

The tape drive may be bi-directional. That is, the controller may be arranged to control the motors to transport tape in both directions between the spools. When a tape is transported in a first direction the torque control motor may be arranged to drive a tape spool supplying tape and the position control motor may be arranged to drive the tape spool taking up tape. The torque-controlled motor may be driven in the opposite direction to the first direction. When a tape is transported in a second direction which is opposite to the first direction, the position-controlled motor may be arranged to drive a tape spool supplying tape and the torque controlled motor may be arranged to drive a tape spool taking up tape, the torque-controlled motor may be driven in the first direction. At least one of the first and second motors may be controllable to operate either as a torque-controlled motor or as a position-controlled motor. That is, the motor may be configured such that it is programmable either to adopt a torque-controlled mode or a position-controlled mode.

A tape drive in accordance with certain embodiments of the present invention relies upon both the motors that drive the two tape spools to drive the tape during tape transport. Thus the two motors operate in push-pull mode. This makes it possible to achieve very high rates of acceleration and deceleration. Tension in the tape being transported is determined by control of the drive motors and therefore is not dependent upon any components that have to contact the tape between the take-up and supply spools. Thus a very simple overall mechanical assembly can be achieved. Given that both motors contribute to tape transport, relatively small and therefore inexpensive and compact motors can be used.

A tape drive in accordance with certain other embodiments of the present invention operates in a pull-drag mode for which the motor attached to the spool currently taking in tape drives the spool in the direction of tape transport, whereas the other spool is driven in a reverse direction in order to tension the tape. In accordance with yet other embodiments of the present invention the tape drive motors may be arranged to operate in a push-pull mode for at least part of a printing cycle and a pull-drag mode for at least another part of the printing cycle.

The actual rotational direction of each spool will depend on the sense in which the tape is wound on each spool. If both spools are wound in the same sense then both spools will rotate in the same rotational direction to transport the tape. If the spools are wound in the opposite sense to one another, then the spools will rotate in opposite rotational directions to transport the tape. In any configuration, both spools rotate in the direction of tape transport. However, according to the operating mode of the supply spool motor, the direction in which it is driven may be also be in the same direction as the supply spool (when the motor is assisting in driving the tape, by pushing the tape off the spool) or the supply spool motor may be driven in the opposite direction to that of the supply spool (when the motor is providing drag to the tape in order to tension the tape).

The tape drive may be incorporated in a transfer printer for transferring ink from a printer tape to a substrate, which is transported along a predetermined path adjacent to the printer. The tape drive may act as a printer tape drive mechanism for transporting ink ribbon between first and second tape spools, and the printer further comprising a printhead arranged to contact one side of the ribbon to press an opposite side of the ribbon into contact with a substrate on the predetermined path. There may also be provided a printhead drive mechanism for transporting the printhead along a track extending generally parallel to the predetermined substrate transport path (when the printer is operating in an intermittent printing mode) and for displacing the printhead into and out of contact with the tape. A controller may control the printer ink ribbon and printhead drive mechanisms, the controller being selectively programmable either to cause the ink ribbon to be transported relative to the predetermined substrate transport path with the printhead stationary and displaced into contact with the ink ribbon during printing, or to cause the printhead to be transported relative to the ink ribbon and the predetermined substrate transport path and to be displaced into contact with the ink ribbon during printing.

The drive mechanism may be bi-directional such that tape may be transported from a first spool to a second spool and from the second spool to the first. Typically, unused tape is provided in a roll of tape mounted on the supply spool. Used tape is taken up on a roll mounted on the take-up spool. However, as described above, in order to prevent gross ribbon wastage, after a printing operation the tape can be reversed such that unused portions of the tape may be used before being wound onto the take-up spool.

BRIEF DESCRIPTION OF THE DRAWINGS

Embodiments of the present invention will now be described, by way of example, with reference to the accompanying drawings, in which.

DETAILED DESCRIPTION OF THE INVENTION

Figure 1:
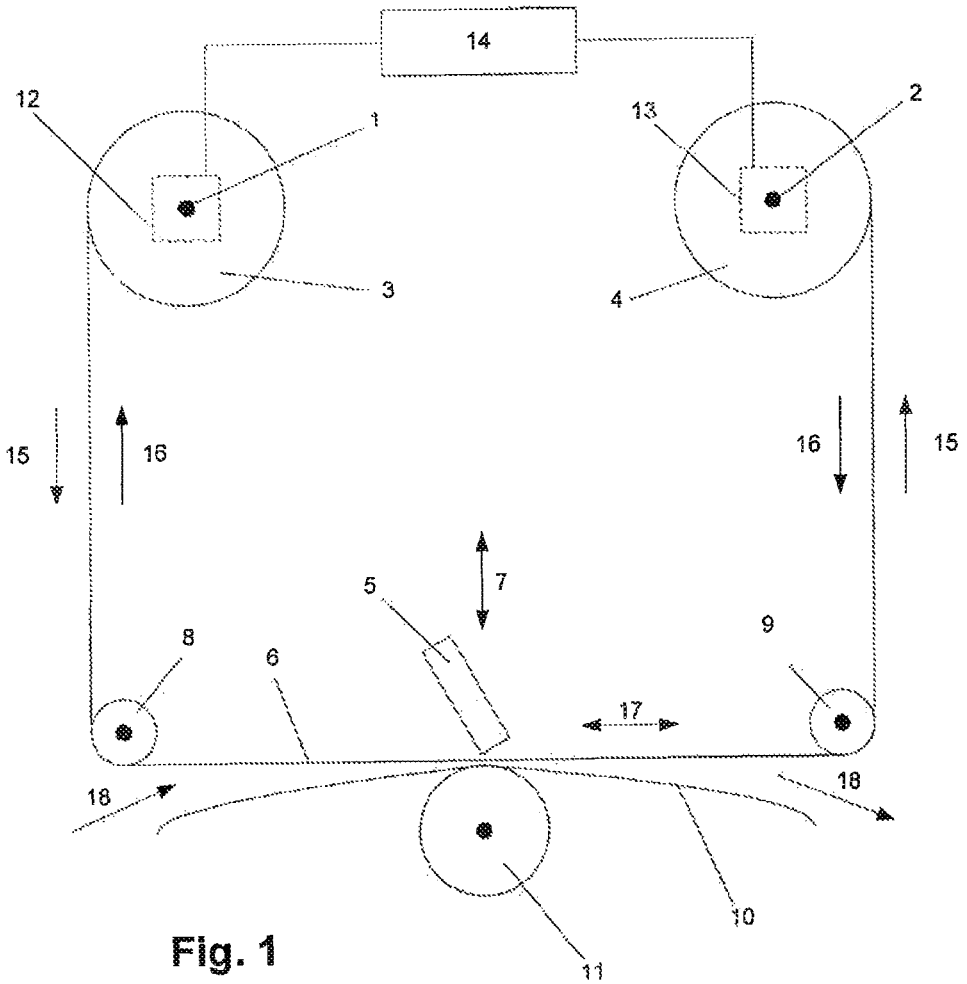
FIG. 1 is a schematic illustration of a printer tape drive system in accordance with an embodiment of the present invention.

Referring to FIG. 1, this schematically illustrates a tape drive in accordance with the present invention suitable for use in a thermal transfer printer. First and second shafts 1, 2 support a supply spool 3 and a take-up spool 4 respectively. The supply spool 3 is initially wound with a roll of unused tape, and the take-up spool 4 initially does not carry any tape. As tape is used, used portions of the tape are transported from the supply spool 3 to the take-up spool 4. A displaceable printhead 5 is provided, displaceable relative to tape 6 in at least a first direction indicated by arrow 7. Tape 6 extends from the supply spool 3 around rollers 8, 9 to the take-up spool 4. The path followed by the tape 6 between the rollers 8 and 9 passes in front of the printhead 5. A substrate 10 upon which print is to be deposited is brought into contact with the tape 6 between rollers 8 and 9, the tape 6 being interposed between the printhead 5 and the substrate 10. The substrate 10 may be brought into contact with the tape 6 against a platen roller 11.

The supply shaft 1 is driven by a supply motor 12 and the take-up shaft 2 is driven by a take-up motor 13. The supply and take-up motors 12, 13 are illustrated in dashed outline, indicating that they are positioned behind the supply and take-up spools 3, 4. It will however be appreciated that in alternative embodiments of the invention, the spools are not directly driven by the motors. Instead the motor shafts may be operably connected to the respective spools by a belt drive or other similar drive mechanism. In either case, it can be seen that there is a fixed transmission ratio between a motor and its respective spool support.

A controller 14 controls the operation of motors 12, 13 as described in greater detail below. The supply and take-up motors 12, 13 are capable of driving the tape 6 in both directions. Tape movement may be defined as being in the print direction if the tape is moving from the supply spool 3 to the take-up spool 4, as indicated by arrows 15. When tape is moving from the take-up spool 4 to the supply spool 3, the tape may be considered to be moving in the tape reverse direction, as indicated by arrows 16.

When the printer is operating in continuous mode the printhead 5 will be moved into contact with the tape 6 when the tape 6 is moving in the print direction 15. Ink is transferred from the tape 6 to the substrate 10 by the action of the printhead 5. Tape movement may be reversed such that unused portions of the tape 6 are positioned adjacent to the printhead 5 before a subsequent printing operation is commenced.

In the configuration illustrated in FIG. 1, the spools 3, 4 are wound in the same sense as one another and thus rotate in the same rotational direction to transport the tape. Alternatively, the spools 3, 4 may be wound in the opposite sense to one another, and thus must rotate in opposite directions to transport the tape.

As described above, the printer schematically illustrated in FIG. 1 can be used for both continuous and intermittent printing applications. The controller 14 is selectively programmable to select either continuous or intermittent operation. In continuous applications, the substrate 10 will be moving continuously. During a printing cycle, the printhead 5 will be stationary but the tape will move so as to present fresh tape to the printhead 5 as the cycle progresses. In contrast, in intermittent applications, the substrate 10 is stationary during each printing cycle, the necessary relative movement between the substrate 10 and the printhead 5 being achieved by moving the printhead 5 parallel to the tape 6 and substrate 10 in the direction of arrow 17 during the printing cycle. In such a case, the roller 11 is replaced with a flat print platen (not shown) against which the printhead 5 presses the ribbon 6 and substrate 10. In both applications, it is necessary to be able to rapidly advance and return the tape 6 between printing cycles so as to present fresh tape to the printhead and to minimise tape wastage. Given the speed at which printing machines operate, and that fresh tape 6 should be present between the printhead 5 and substrate 10 during every printing cycle, it is necessary to be able to accelerate the tape 6 in both directions at a high rate and to accurately position the tape relative to the printhead. In the arrangement shown in FIG. 1 it is assumed that the substrate 10 will move only to the right as indicated by arrows 18. However, the apparatus can be readily adapted to print on a substrate travelling to the left (that is, in the opposite direction) in FIG. 1.

In accordance with embodiments of the present invention, one of the supply motor 12 and/or the take-up motor 13 is a torque-controlled motor. The other motor is a position-controlled motor.

A torque-controlled motor is a motor that is controlled by a demanded output torque. An example of a torque-controlled motor is a DC motor without encoder feedback, or a DC motor having an encoder, but in which the encoder signal is temporarily or permanently not used. Alternatively, coupling a stepper motor with an encoder and using the encoder output signal to generate a commutation signal that in turn drives the motor can provide a torque-controlled stepper motor. Varying the current that may be drawn by the motor can vary the torque provided by a torque-controlled motor of either sort.

A position-controlled motor comprises a motor controlled by a demanded output rotary position. That is, the output position may be varied on demand, or the output rotational velocity may be varied by control of the speed at which the demanded output rotary position changes.

An example of a position-controlled motor is a stepper motor. A stepper motor is an open loop position-controlled motor, that is, it is supplied with an input signal relating to a demanded rotational position or rotational velocity, the stepper motor being driven to achieve the demanded position or velocity. A stepper motor may also be provided with an encoder providing a feedback signal indicative of the actual output position or velocity. The feedback signal may be used to generate an error signal by comparison with the demanded output rotary position, the error signal being used to drive the motor to minimise the error. A stepper motor provided with an encoder in this manner comprises a closed loop form of position-controlled motor.

An alternative form of closed loop position-controlled motor comprises a DC motor provided with an encoder. The output from the encoder provides a feedback signal from which an error signal can be generated when the feedback signal is compared to a demanded output rotary position, the error signal being used to drive the motor to minimise the error.

In the present context the term "DC motor" is to be interpreted broadly as including any form of motor that can be driven to provide an output torque, such as for example a brushless DC motor, a brushed DC motor, an induction motor or an AC motor. A brushless DC motor comprises any form of electronically commutated motor with integral commutation sensor. Similarly, the term stepper motor is to be interpreted broadly as including any form of motor that can be driven by a drive signal, each pulse indicating a required change of rotary position.

An encoder is any form of angular position sensing device, such as an optical encoder, magnetic encoder, resolver, capacitive encoder or any other form of position sensing device. An encoder may be connected to an output shaft of a motor and used to provide a feedback signal indicating the angular position or motion of the motor output shaft.

In one embodiment of the invention the take up motor 13 is a position-controlled motor (of any sort, as described above such as an open or closed loop stepper motor or a DC motor provided with a position encoder) and the supply motor 12 is a torque-controlled motor (of any sort, as described above such as a DC motor without a feedback signal from a position encoder or a stepper motor which derives its commutation signal from an output position encoder).

When the tape is travelling in the print direction the tape drive operates in a pull-drag mode. That is, the torque-controlled supply motor 12 provides a dragging force acting on the tape in order to keep the tape tensioned. The torque-controlled supply motor 12 is driven in the opposite direction to the direction of tape transport, however the force applied to the tape is chosen such that the position-controlled take up motor 13 is able to overpower the torque-controlled supply motor 12 such that the supply spool rotates in the direction of tape transport. Tension in the tape can be controlled by appropriate control of the torque-controlled motor, for example by controlling the current supplied to a brushed DC motor. The take-up motor is driven at the appropriate angular velocity in order to drive the tape past the printhead at the correct speed.

When the tape is travelling in the tape reverse direction, the tape drive operates in a push-pull mode. The torque-controlled supply motor applies a pulling force to the tape, and is responsible for setting the tension within the tape by appropriate control of the supply motor 12. The position-controlled take-up motor is driven to assist in transporting the tape, by being driven in the direction of tape transport; however, the position-controlled take-up motor is arranged to rotate less fast than the supply motor so that the net effect is that the tape remains tensioned between the spools.

As a further alternative, the supply and the take-up motors may be such that each motor can act as either a position-controlled motor or a torque-controlled motor. Such motors are referred to herein as dual control mode motors. A suitable motor for this purpose is a DC motor provided with an output position encoder. When operating in a position-controlled mode, the encoder output position signal is used as a feedback signal. When operating in a torque-controlled mode, the encoder output position signal is not used.

An alternative suitable dual control mode motor is an open loop position control motor (such as a stepper motor) provided with an output position encoder. When operating in a position-controlled mode either the encoder signal is not used or the encoder signal is used to provide a closed loop position-controlled stepper motor. When operating in a torque-controlled mode the encoder output signal is used to provide the commutation signal to the open loop position controlled motor.

By providing both spools with dual control mode motors the tape drive may be operated in push-pull mode in both directions (that is, the print direction and the tape reverse direction). Alternatively, the tape drive may be operated in pull-drag mode in both directions. This advantageously means that the drive signals controlling the motors can be the same when the tape is being transported in both directions (the only difference being the motor to which each drive signal is provided). For simplicity it may be that the same type of motor is used to drive both the supply spool and the take-up spool, however this need not be the case.

As yet a further variant, when the tape is being transported in the print direction, for a supply motor comprising a stepper motor and an output position encoder, the supply motor may operate in position control mode using encoder feedback (that is, closed loop position control). Closed loop position-controlled motors are preferred because as they have direct feedback of the actual output position this can be used in combination with the demanded output position in order to generate an error signal such that the motor is driven to minimise the error until the actual output position is equal to the demanded output position. A torque-controlled take-up motor such as a DC motor operating without encoder position feedback pulls the tape to set the tape tension. When the tape is being transported in the tape reverse direction both motors may operate in position control mode (the supply motor again acting as a closed loop position-controlled motor, or as an open loop position-controlled motor, and the take-up motor operating as a closed loop position-controlled DC motor). The result is that the tape drive operates in push-pull mode in both directions, however the implementation of the push-pull tape drive is different in each direction.

Further variants will be readily apparent to the appropriately skilled person, from the teaching herein, in the form of other combinations of DC motors and stepper motors with or without output position feedback, or indeed any other form of position-controlled or torque-controlled motors that are known in the art.

For a pair of motors within a tape drive, the drive signal supplied to the motor is varied as the diameter of the supply spool and the take-up spool vary and as the required tape tension varies. Determining the appropriate motor drive signal requires that the spool diameters are determined in order that the demanded motor torque or the demanded motor position for the printing operation can be adjusted accordingly.

One known method of monitoring the diameter of a spool of tape is based upon optical sensing comprising at least one emitter and detector pair. The emitter and detector pair is arranged such that as the diameter of the spool changes, the spool blocks that signal from the emitter to the detector, which may be detected. Such an optical spool diameter monitoring technique is disclosed in GB 2,369,602.

An alternative method for determining tape spool diameter is disclosed in GB 2,298,821. Here, tape is passed around an idler roller of known diameter. The idler roller is provided with an anti-slip coating to prevent slippage occurring between the tape and the idler roller when the tape is moved. The outer diameter of the idler roller is measured. Rotation of the idler roller is monitored. This is achieved by providing the idler roller with a magnetic disc having a north and south pole. Rotation of the idler roller can then be detected by an appropriate magnetic sensor. By detecting rotation of the idler roller of known diameter and knowing a number of steps through which a stepper motor has turned the diameter of a spool of tape associated with the stepper motor can be determined.

The drive signal controlling the torque controlled motor is optimised to apply an appropriate torque to the associated spool such that the tape is correctly tensioned at any time. However, a spool of tape has a significant mass, and hence at times at which the direction of tape transport is reversed or during rapid acceleration or deceleration the inertia of the spool may act to alter the effective tension applied to the tape. If uncorrected the effect of this inertia may take the tape tension beyond predetermined safe limits, risking damage to both the tape and the tape drive itself.

The moment of inertia of a spool of tape supported upon the spool, about a spool axis, can be calculated as follows:

$$J=J_S+\tfrac{1}{2}M(R_2^2+R_1^2) \quad (1)$$

where:

J is moment inertia of the mass driven by the motor;

$J_S$ is the moment of inertia of the spool support, the core upon which the spool is wound and the rotor of the motor;

M is the mass of the spool of tape;

$R_1$ is the inner radius of the spool of tape; and $R_2$ is the outer radius of the spool of tape.

Figure 2:
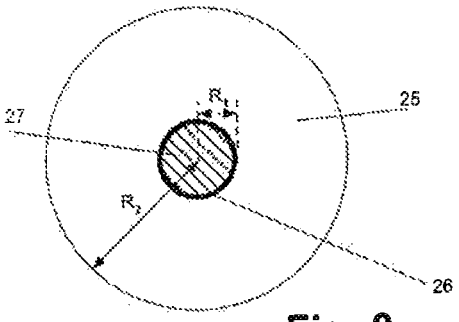
FIG. 2 is a schematic illustration of a spool of tape.

FIG. 2 shows an appropriate spool of tape. It can be seen that a spool of tape 25 is wound about a core 26. The outer radius of the spool $R_2$ and the inner radius of the spool $R_1$ are also illustrated. It can be seen that the core 26 is mounted on a spool support 27.

It can be seen from this equation that the inertia of the spool of tape is dependent upon the radius of the spool, and thus upon the diameter of the spool, which may be measured or determined directly or indirectly as discussed above.

As noted above, during periods of rapid acceleration or deceleration, or when the direction of tape transport is reversed, the effect of the inertia of the spool or spools on tape tension is at its maximum. In order to compensate for this effect, in accordance with an embodiment of the present invention an additional component of the drive signal provided to the or each torque-controlled motor in a tape drive can be calculated.

The drive signal provided to a brushless DC torque-controlled motor comprises a current which is varied according to the direction of tape transport and whether the tape is operating in the steady state, accelerating or decelerating. The direction of the current supplied to a torque controlled motor determines the direction in which the motor is driven. The magnitude of the supply current determines the torque that is applied by the motor to the spool of tape.

In accordance with an embodiment of the present invention, the additional component comprises an additional motor supply current component that is added to or subtracted from the motor drive current in order to modify the torque applied by the motor to compensate for the inertial loading of the spool.

The additional torque component required to overcome the inertial loading of the spool of tape can be calculated as follows:

$$T=J\alpha \quad (2)$$

where:

T is the torque; and $\alpha$ is the angular acceleration.

The required torque can be calculated as above. The angular acceleration is known at any particular time. Specifically, an acceleration profile associated with tape transport is established. This means that angular acceleration at any time can be determined from the acceleration profile. Inertia can be calculated as described above.

The torque generated by many torque-controlled motors is directly proportional to the current supplied to the motor. Consequently, the additional current component to be added to or subtracted from the motor drive current can be calculated based upon a relationship between torque and current for a particular motor, as represented by the motor's torque constant.

When the tape drive is operating in push-pull mode, with the torque-controlled motor pulling the tape, inertial compensation can be used to provide additional torque in order to prevent the inertia of the take-up spool resulting in a reduction of tape tension when the tape is being accelerated. When the tape is being decelerated, inertial compensation can be used to reduce the torque applied to the spool taking-up tape in order to assist in decelerating the tape and to prevent the tape tension increasing beyond safe levels.

When the tape drive is operating in pull-drag mode, with the torque-controlled motor dragging the tape, inertial compensation can be used to provide additional torque in the reverse direction to tape transport in order to prevent the inertia of the spool supplying tape resulting in the tape tension reducing when the tape is being decelerated. When the tape is being accelerated, inertial compensation can be used to reduce the torque applied to the spool supplying tape in order to assist in accelerating the tape and to prevent the tape tension increasing beyond safe levels.

When the direction of tape transport changes, a torque controlled motor may switch from dragging the tape to pulling the tape, or from pulling the tape to dragging the tape. For either change, the direction in which the motor is being driven does not change. That is, given that the direction of tape movement has changed, and given that the motor is driven in the direction of tape transport in one tape movement direction, and in a direction opposite to that of tape transport in the other movement direction, the motor continues to be driven in the same rotational direction.

The effect of inertial compensation when the direction of tape transport is reversed is to change the drive signal to the motor. Indeed, for rapid changes in tape direction, in order to prevent excessive tape tension the drive signal applied to a torque controlled motor may even briefly be reversed. That is, to assist in tape transport when going from pulling to dragging, the torque-controlled motor may briefly switch to pushing the tape in order to assist in reversing the tape direction.

As discussed above, the effect of inertial compensation in accordance with embodiments of the present invention is in addition to the drive signal applied to the torque-controlled motor in order to drive the tape in the steady state.

A stepper motor driving a tape may be caused to stall under excessive tape tension, which may occur due to inertial loading when the tape changes direction or when the tape is being rapidly accelerated or decelerated. A further benefit of inertial compensation, in addition to preventing damage to the tape, is that if the other tape drive motor comprises a position-controlled stepper motor then the risk of the stepper motor stalling is reduced.

Before inertial compensation can be applied it is necessary to calibrate the torque-controlled motor in order to accurately determine the relationship between the current supplied to the motor and the change in torque generated by the motor. This calibration may be performed empirically either before the tape drive is in operation or periodically throughout the tape drive's use. The calibration is to determine the angular acceleration provided to a spool per unit of current supplied to the torque-controlled motor where torque is directly proportional to current:

$$A=K_tI/J \tag{3}$$

where:

A is the acceleration per unit of current;

I id provided current; and $K_t$ is the torque constant of the motor.

This calibration can be performed by a number of different methods. In first and second calibration methods, the tape between the spools is initially held slack and the second motor is held stationary. A known drive current is supplied to the torque controlled motor. The acceleration of the spool can be measured. In the first calibration method the acceleration is directly measured, for instance using an encoder attached to the motor. In the second calibration method the acceleration is indirectly measured by timing commutation pulses supplied to the torque controlled motor. This second calibration method is disadvantageous because it requires the torque-controlled motor to rotate a significant number of times before the spool acceleration can be measured, which consequently requires a significant amount of slack tape between the spools (which is undesirable due to the potential for tangling the tape).

A third calibration method which is currently preferred involves the tape between the spools being held taut. A known supply current drives a first torque-controlled motor (driving a first spool) while a second motor (driving a second spool) is allowed to free wheel. In this way the composite acceleration of the masses driven by the two spool motors can be measured. This composite acceleration is the acceleration of the inertia of the first spool, and the inertia of the second spool reflected through the gearing ratio of the diameters of the first and second spools. By repeating this process by driving the second motor a second composite acceleration can be measured. By knowing the diameters of the spools, the inertia of each spool can then be calculated.

The third calibration method can be expressed mathematically as follows:

First Define:

Ja to be total shaft inertia on first spool;

Jb to be total shaft inertia on second spool;

Ra2 to be outer radius of first spool;

Rb2 to be outer radius of second spool;

Ta to be shaft torque on the first spool while doing the first measurement;

Tb to be shaft torque on the second spool while doing the second measurement;

αa to be measured acceleration on first spool; and

αb to be measured acceleration on second spool.

The radiuses Ra2, Rb2 are known, Torques Ta, Tb are also known by setting currents supplied to the motors, and knowing the relationship between torque and current for each motor, i.e. the motors' torque constants. Accelerations αa and αb are measured. The only unknown variables are Ja and Jb. These are calculated by the following formulae:

Define:

Jac to be composite inertia of first spool;

The to be composite inertia of second spool:

$$k \text{ to be } \frac{Ra2}{Rb2}$$

That is, k is the gearing ratio between the two spool diameters.

$$Jac = Ja + Jbk^2 \tag{4}$$

$$Jbc = Jb + \frac{Ja}{k^2} \tag{5}$$

Rearranging equation (4):

$$Ja=Jac-Jbk^2 \tag{6}$$

Rearranging equation (5):

$$Jb = Jbc - \frac{Ja}{k^2} \tag{7}$$

Substituting equation (7) into equation (6):

$$Ja = Jac - \left(Jbc - \frac{Ja}{k^2}\right)k^2 \tag{8}$$

$$Ja = Jac - Jbck^2 - Ja \tag{9}$$

$$2Ja = Jac - Jbck^2 \tag{10}$$

$$Ja = \frac{Jac - Jbck^2}{2} \tag{11}$$

Substituting equation (6) into equation (7):

$$Jb = Jbc - \left(\frac{Jac - Jbk^2}{k^2}\right) \tag{12}$$

$$Jb = Jbc - \frac{Jac}{k^2} - Jb \tag{13}$$

$$2Jb = Jbc - \frac{Jac}{k^2} \tag{14}$$

$$Jb = \frac{Jbc - \frac{Jac}{k^2}}{2} \tag{15}$$

Since, from equation (2):

$$T = J\alpha \tag{16}$$

$$Ta = Jac\alpha a \tag{17}$$

$$Jac = \frac{Ta}{\alpha a} \tag{18}$$

$$Tb = Jbc\alpha b \tag{19}$$

$$Jbc = \frac{Tb}{\alpha b} \tag{20}$$

Substituting equation (18) and (20) into equation (11):

$$Ja = \frac{1}{2}\left(\frac{Ta}{\alpha a} - \frac{Tb}{\alpha b}k^2\right) \tag{21}$$

Substituting equation (18) and (20) into equation (15):

$$Jb = \frac{1}{2}\left(\frac{Tb}{\alpha b} - \left(\frac{Ta}{\alpha a}\right)\frac{1}{k^2}\right) \tag{22}$$

$$Jb = \frac{1}{2}\left(\frac{Tb}{\alpha b} - \frac{Ta}{\alpha a k^2}\right) \tag{23}$$

Equation (26) and (24) provide the desired inertias Ja and Jb which can then be used for compensation calculations as described above.

As noted above, tape drives in accordance with embodiments of the present invention may be used in thermal transfer printers of the type described above. Tape drives in accordance with embodiments of the present invention may be advantageously used in a thermal transfer over printer, such as may be used within the packaging industry, for instance for printing further information such as dates and bar codes over the top of pre-printed packaging (such as food bags).

Additionally, tape drives in accordance with embodiments of the present invention may be used in other applications, and provide similar advantages to those evident in thermal transfer printers, for instance fast and accurate tape acceleration, deceleration, speed and positional accuracy.

An alternative application where such tape drives may be applied is in labelling machines, which are adapted to apply labels detached from a continuous tape (alternatively referred to as a label web). Tape drives in accordance with embodiments of the present invention are suitable for use in labelling machines in which a label carrying web is mounted on a supply. Labels are removed from the web, and the web is driven onto a take-up spool.

In general, tape drives in accordance with embodiments of the present invention may be used in any application where there is a requirement to transport any form of tape, web or other continuous material from a first spool to a second spool.

Further modifications and applications of the present invention will be readily apparent to the appropriately skilled person from the teaching herein, without departing from the scope of the appended claims.

What is claimed is:

1. A thermal transfer printer incorporating a tape drive comprising two motors, two tape spool supports on which spools of tape are mounted, each spool being drivable by a respective one of the said motors and a controller for controlling the energization of the motors such that the tape may be transported in at least one direction between spools mounted on the spool supports, wherein at least one of the motors is selectively controllable to operate either as a torque-controlled motor or a position-controlled motor.

2. A thermal transfer printer according to claim 1, wherein the at least one of the motors which is selectively controllable to operate as either a torque-controlled motor or a position-controlled motor is a DC motor having an output position encoder.

3. A thermal transfer printer according to claim 1, further comprising a controller configured to control a first one of the motors to operate as a position-controlled motor and a second one of the motors to operate as a torque-controlled motor.

4. A thermal transfer printer according to claim 1, further comprising a controller configured to control energization of the motors to transport the tape in a first direction and a second direction between the spools, wherein the first and second directions of tape transport are generally opposite to one another.

5. A thermal transfer printer according to claim 1, further comprising a controller, wherein the at least one of the motors selectively controllable to operate either as a torque-controlled motor or a position-controlled motor is operated by said controller as a position-controlled motor during transport of the tape to drive its spool support to a commanded angular position to take-up or supply a predetermined amount of tape.

6. A thermal transfer printer according to claim 1, further comprising a controller, wherein the at least one of the motors selectively controllable to operate either as a torque-controlled motor or a position controlled motor is operated by said controller as a torque-controlled motor to deliver a predetermined level of torque to set tension in the tape transported between the spools.

7. A thermal transfer printer according to claim 6, wherein operating said motor as a torque-controlled motor to deliver a predetermined level of torque comprises setting a supply current for said motor.

8. A thermal transfer printer for selectively transferring an ink material carried on a tape to a substrate intended to receive printing to transfer an image from the tape to the substrate, the printer comprising:

two spool supports for spools of tape carrying ink material, with the tape being wound on the spools and with a span of tape being held in tension between the spools, the tape spools being carried on and driveable by the respective spool supports, and the tape being of the single strike type for which a region of fresh tape must be made available for printing each image to the substrate during a printing operation;

a print head positioned at the span of tape between the tape spools, the print head being mounted for selective movement between an extended position adjacent the span of tape between the spools and a retracted position spaced apart from the span of tape between the tape spools and comprising heating elements selectively energized for transferring ink material on the span of tape between the tape spools to the substrate when the print head is moved to its extended position and into contact with the tape while the tape is in contact with the substrate to print an image, wherein the print head is moved to its retracted position between printings of consecutive adjacent images on the substrate;

a tape drive for selectively transporting tape between the spools of tape comprising a first motor and a second motor, each driving a spool of tape via its spool support, wherein at least one of the motors is selectively controllable to operate either as a torque-controlled motor or a position-controlled motor;

the tape drive further comprising a controller configured to control the energization of the motors to transport the tape in a first direction and a second direction between the spools, wherein the first and second directions of tape transport are generally opposite to one another;

the controller further being configured to selectively control energization of the first or second motors such that one of the motors is operated as a position-controlled motor during transport of the tape in the first direction and the second direction to drive its spool support to a commanded angular position to take-up or supply a predetermined length of tape to the span of tape between the spools;

the controller further being configured, when the tape is transported in either the first direction or the second direction, to control energization of the first or second motors to operate as a torque-controlled motor to drive a spool support to deliver a predetermined level of torque to set tension in the span of tape extending from one spool to the other spool; and the controller further being configured to determine a motor drive current to be provided to the motor being operated as a torque-controlled motor to set tension in the span of tape extending from one spool to the other spool.

9. The thermal transfer printer of claim 8, wherein when the tape is transported in a first direction the first motor is operated as a torque-controlled motor arranged to drive a tape spool supplying tape and the second motor is operated as a position-controlled motor arranged to drive a tape spool taking up tape, the torque-controlled motor being driven in a second direction opposite to the first direction, and when the tape is transported in the second direction the second motor is operated as a torque-controlled motor arranged to drive a tape spool supplying tape and the first motor is operated as a position-controlled motor arranged to drive a tape spool taking up tape, the torque-controlled motor being driven in the first direction.

* * * * *